US009476676B1

(12) United States Patent
Greenslade et al.

(10) Patent No.: US 9,476,676 B1
(45) Date of Patent: Oct. 25, 2016

(54) WEAPON-SIGHT SYSTEM WITH WIRELESS TARGET ACQUISITION

(71) Applicant: Knight's Armament Co., Titusville, FL (US)

(72) Inventors: Kenneth Greenslade, Mims, FL (US); Glen Francisco, Titusville, FL (US); Michael C. Amorelli, Danville, NH (US)

(73) Assignee: Knight Vision LLLP, Titusville, FL (US)

( * ) Notice: Subject to any disclaimer, the term of this patent is extended or adjusted under 35 U.S.C. 154(b) by 145 days.

(21) Appl. No.: 14/458,784

(22) Filed: Aug. 13, 2014

Related U.S. Application Data

(60) Provisional application No. 61/878,024, filed on Sep. 15, 2013.

(51) Int. Cl.
*G06F 19/00* (2011.01)
*F41G 1/32* (2006.01)
*F41G 3/00* (2006.01)

(52) U.S. Cl.
CPC .. *F41G 1/32* (2013.01); *F41G 3/00* (2013.01)

(58) Field of Classification Search
CPC ..... F41G 1/38; F41G 1/32; F41G 3/06; F41G 3/142; F41G 1/473; G02B 27/017; G02B 2027/0138; G02B 23/125; G02B 27/0189; G02B 27/0093; F41A 33/00
USPC ..... 235/404, 409, 439, 407, 406
See application file for complete search history.

(56) References Cited

U.S. PATENT DOCUMENTS 5,949,015 A 9/1999 Smith et al.
6,899,539 B1 5/2005 Stallman et al.
7,210,392 B2 5/2007 Greene et
7,818,910 B2 10/2010 Young
7,870,816 B1 1/2011 Willingham et al.
8,020,769 B2 9/2011 Papale et al.
8,093,992 B2 1/2012 Jancic et al.
8,245,623 B2 8/2012 Weaver
8,336,776 B2 12/2012 Horvath et al.
8,408,115 B2 4/2013 Barger
8,656,628 B2 2/2014 Jock et al.
2005/0233284 A1* 10/2005 Traykov ..... F41G 3/2611 434/16
2006/0258454 A1* 11/2006 Brick ..... A63F 13/06 463/36
2008/0094473 A1 4/2008 Rom
2009/0188976 A1 7/2009 Gunnarsson et al.
2011/0030545 A1* 2/2011 Klein ..... F41G 1/393 89/41.05
2011/0031928 A1 2/2011 Soar
2011/0261204 A1* 10/2011 Smith ..... F41C 27/00 348/159
2012/0097741 A1 4/2012 Karcher
2013/0133510 A1 5/2013 Piazza et al.
2013/0273504 A1* 10/2013 Carter ..... F41A 33/00 434/19
2014/0178841 A1* 6/2014 Carter ..... F41G 3/2605 434/19
2015/0309316 A1* 10/2015 Osterhout ..... G02B 27/0172 345/8

* cited by examiner

*Primary Examiner* — Thien M Le
(74) *Attorney, Agent, or Firm* — Opticus IP Law PLLC

(57) ABSTRACT

A weapon-sight system for use with a weapon for performing wireless target acquisition of a target is disclosed. The system includes a weapon sight that is mountable onto the weapon and adapted to capture a thermal weapon-sight image of the target and transmit a wireless signal representative of the weapon-sight image. The system also includes a display system that is not physically connected to either the weapon sight or to the weapon and that is adapted to capture a thermal display-system image of the target. The display system includes a processor configured to combine the weapon-sight image and the display-system image so that a user can view at least a portion of the weapon-sight image using the display of the display system.

25 Claims, 12 Drawing Sheets

Picture in Picture RTA Mode – Weapon Sight on ENVG

WEAPON-SIGHT SYSTEM WITH WIRELESS TARGET ACQUISITION

CROSS-REFERENCE TO RELATED APPLICATIONS

This application claims the benefit of priority under 35 USC 119 of U.S. Provisional Application Ser. No. 61/878,024, filed on Sep. 15, 2013, and which is incorporated by reference herein.

FIELD

The present disclosure relates to weapon sights, and in particular relates to a weapon-sight system with wireless target acquisition.

BACKGROUND

Many types of weapons (such as rifles) have weapon sights that allow the weapon's user to view a target within a scene and align the weapon relative to the target, e.g., to a select a bullet impact point. A typical weapon sight includes a cross-hair reticle. The weapon sight is adjusted ("aligned") so that cross-hairs match the desired bullet impact point for a given target distance. The typical weapon sight is configured to removably mount to a military standard rail mount ("rail") (e.g., MIL-STD 1913) that runs along the top and/or side of the weapon (forend and barrel).

Certain types of weapon sights have night-vision capability and are referred to as "night-vision optics" or "night optics." The night-vision optics "clip on" to the rail and may be arranged in-line with removable "day vision optics" or "day optics" used for daytime viewing, with the night-vision optics augmenting the day-vision optics for nighttime use. Some night-vision optics include an eyepiece that allows for direct viewing of the scene using just the night-vision optics so that that viewing through the day-vision optics is not required. Either way, to view a target at night, the night-vision optics must be used.

One type of night-vision optics employs passive, long-wavelength (e.g., 7.5 μm to 14 μm) thermal imaging, wherein a thermal image of the target is detected by a thermally sensitive (i.e., infrared) detector and then transmitted to a visible display within the night-vision optics. Thus, the weapon user does not view the target or scene directly, but rather views an image of the target or scene on a small display within the night-optics housing. Night-vision optics that employ thermal imaging are also called "thermal sights" or "thermal scopes."

In nighttime applications, the weapon's user may be wearing a helmet that includes night-vision viewing equipment such as night-vision goggles. The night-vision goggles can employ thermal imaging, image intensification, or both. In order to aim the weapon at the target at night, the soldier will need to swing the night-vision goggles out of the way to gain access to the eyepiece of the weapon sight's night-vision optics. The soldier then has to hold the weapon in such a way that allows them to look through the eyepiece of the night-vision optics and then adjust the position of the weapon as needed to align the cross-hairs to a desired target impact point prior to firing the weapon. This process delays and complicates the target acquisition in life-threating situations where quick target acquisition is critical.

SUMMARY

An aspect of the disclosure is a weapon-sight system for use with a weapon for performing wireless acquisition of a target. The system includes a weapon sight that is mountable onto the weapon and that is adapted to capture a thermal weapon-sight image of the target, the weapon sight having a wireless transmitter to generate a first wireless signal representative of the weapon-sight image of the target. The system also includes a display system that is not physically connected to either the weapon sight or the weapon. The display system includes: a) a night-vision optical system and thermal sensor adapted to capture a display-sight image of the target and generate a second electrical signal representative of the display-system image of the target; b) a wireless receiver adapted to receive the first wireless signal and generate a first electrical signal; c) a display; and d) a processor that receives and processes the first and second electrical signals and causes the display to display either: a) at least a portion of the weapon-sight image, or b) a combination of at least a portion of the weapon-sight image and at least a portion of the display-system image.

Another aspect of the disclosure is the weapon-sight system as described above, and wherein the weapon sight includes a first inertial measurement unit that generates weapon-sight inertial data; wherein the display system includes a second inertial measurement unit that generates display-system inertial data; and wherein the processor is configured to receive and process the weapon-sight inertial data and the display-system inertial data to align the weapon-sight image relative to the display-system image.

Another aspect of the disclosure is the weapon-sight system as described above, wherein the display system comprises a night-vision goggle.

Another aspect of the disclosure is the weapon-sight system as described above, wherein the display system comprises a heads-up display.

Another aspect of the disclosure is the weapon-sight system as described above, wherein the processor is configured to import targeting information from the weapon-sight image into the display-system image.

Another aspect of the disclosure is the weapon-sight system as described above, wherein the first wireless signal is encrypted at the weapon and decrypted at the display system.

Another aspect of the disclosure is the weapon-sight system as described above, wherein the weapon-sight image includes targeting information.

Another aspect of the disclosure is the weapon-sight system as described above, wherein the targeting information includes at least one of: cross-hairs, an aimpoint, target zero, and a bullet impact point.

Another aspect of the disclosure is the weapon-sight system as described above, wherein the first wireless signal has an ultra-wide bandwidth.

Another aspect of the disclosure is the weapon-sight system as described above, wherein the processor is configured to generate a picture-in-picture configuration of the weapon-sight image and the display-system image.

Another aspect of the disclosure is a method of performing wireless acquisition of a target for use by a user. The method includes: capturing a thermal weapon-sight image of the target using a weapon sight on a weapon without looking through the weapon sight; capturing a display-system image of the target using a display system that is not physically connected to either the weapon sight or the weapon; wirelessly transmitting the weapon-sight image to the display system; and displaying at least a portion of the weapon-sight image on a display of the display system so that the user can view the weapon-sight image using the display system.

Another aspect of the disclosure is the method as described above, wherein the weapon comprises a long-range weapon.

Another aspect of the disclosure is the method as described above, wherein the display system comprises a night-vision goggle.

Another aspect of the disclosure is the method as described above, wherein the display system comprises a heads-up display.

Another aspect of the disclosure is the method as described above, and further including: performing first inertial measurements at the weapon sight and second inertial measurements at the display system; and aligning the weapon-sight image with the display-system image based on the first and second inertial measurements.

Another aspect of the disclosure is the method as described above, wherein the weapon sight has a position, and including collecting inertial measurement data at the weapon sight and the display system and processing the inertial measurement data to track the position of the weapon sight.

Another aspect of the disclosure is the method as described above, further comprising combining the at least portion of the weapon-sight image with at least a portion of display-system image.

Another aspect of the disclosure is the method as described above, wherein the weapon-sight image includes targeting information.

Another aspect of the disclosure is the method as described above, wherein the targeting information includes at least one of: cross-hairs, an aimpoint, target zero, and a bullet impact point.

Another aspect of the disclosure is a weapon-sight system for performing wireless acquisition of a target for use by a user. The system includes: a weapon sight adapted to capture a weapon-sight image of the target using a weapon-sight on the weapon without looking through the weapon sight; a display system that is not physically connected to either the weapon sight or the weapon, the display system including a processor and a display and being configured to capture a display-system image; a wireless transmitter at the weapon sight that is adapted to wirelessly transmit the weapon-sight image to the display system; and wherein the processor is adapted to cause the weapon-sight image to be displayed on the display so that the user of the display system can view the weapon-sight image.

Another aspect of the disclosure is the weapon-sight system as described above, wherein the weapon sight consists of a night-vision weapon sight.

Another aspect of the disclosure is a weapon-sight system for performing wireless acquisition of a target. The weapon-sight system includes: a weapon sight adapted to capture a weapon-sight image of the target using a weapon-sight on the weapon without looking through the weapon sight; a display system that is not physically connected to either the weapon sight or the weapon, the display system including a processor and a display and configured to capture a display-system image; a wireless transmitter at the weapon sight that is adapted to wirelessly transmit the weapon-sight image to the display system; and wherein the processor is adapted to combine at least a portion of the weapon-sight image with at least a portion of the display-system image to form a combined image, and to cause the combined image to be displayed on the display so that a user of the display system can view the combined image.

Another aspect of the disclosure is the weapon-sight system as described above, wherein the weapon-sight image includes targeting information.

Another aspect of the disclosure is the weapon-sight system as described above wherein the targeting information includes at least one of: cross-hairs, an aimpoint, target zero, and a bullet impact point.

Another aspect of the disclosure is the weapon-sight system as described above wherein the weapon sight consists of a night-vision weapon sight.

Additional features and advantages are set forth in the Detailed Description that follows, and in part will be readily apparent to those skilled in the art from the description or recognized by practicing the embodiments as described in the written description and claims hereof, as well as the appended drawings. It is to be understood that both the foregoing general description and the following Detailed Description are merely exemplary, and are intended to provide an overview or framework to understand the nature and character of the claims.

BRIEF DESCRIPTION OF THE DRAWINGS

The accompanying drawings are included to provide a further understanding, and are incorporated in and constitute a part of this specification. The drawings illustrate one or more embodiment(s), and together with the Detailed Description serve to explain principles and operation of the various embodiments. As such, the disclosure will become more fully understood from the following Detailed Description, taken in conjunction with the accompanying Figures, in which.

DETAILED DESCRIPTION

Reference is now made in detail to various embodiments of the disclosure, examples of which are illustrated in the accompanying drawings. Whenever possible, the same or like reference numbers and symbols are used throughout the drawings to refer to the same or like parts. The drawings are not necessarily to scale, and one skilled in the art will recognize where the drawings have been simplified to illustrate the key aspects of the disclosure.

The claims as set forth below are incorporated into and constitute part of this detailed description.

The entire disclosure of any publication or patent document mentioned herein is incorporated by reference.

In the discussion below, the term "user" refers to a person who uses the weapon, with example users including soldiers, paramilitary personnel, law-enforcement personnel (e.g., police, FBI, DEA, SWAT members), and civilians (e.g., sportsman, hunters, etc.).

Figure 1:
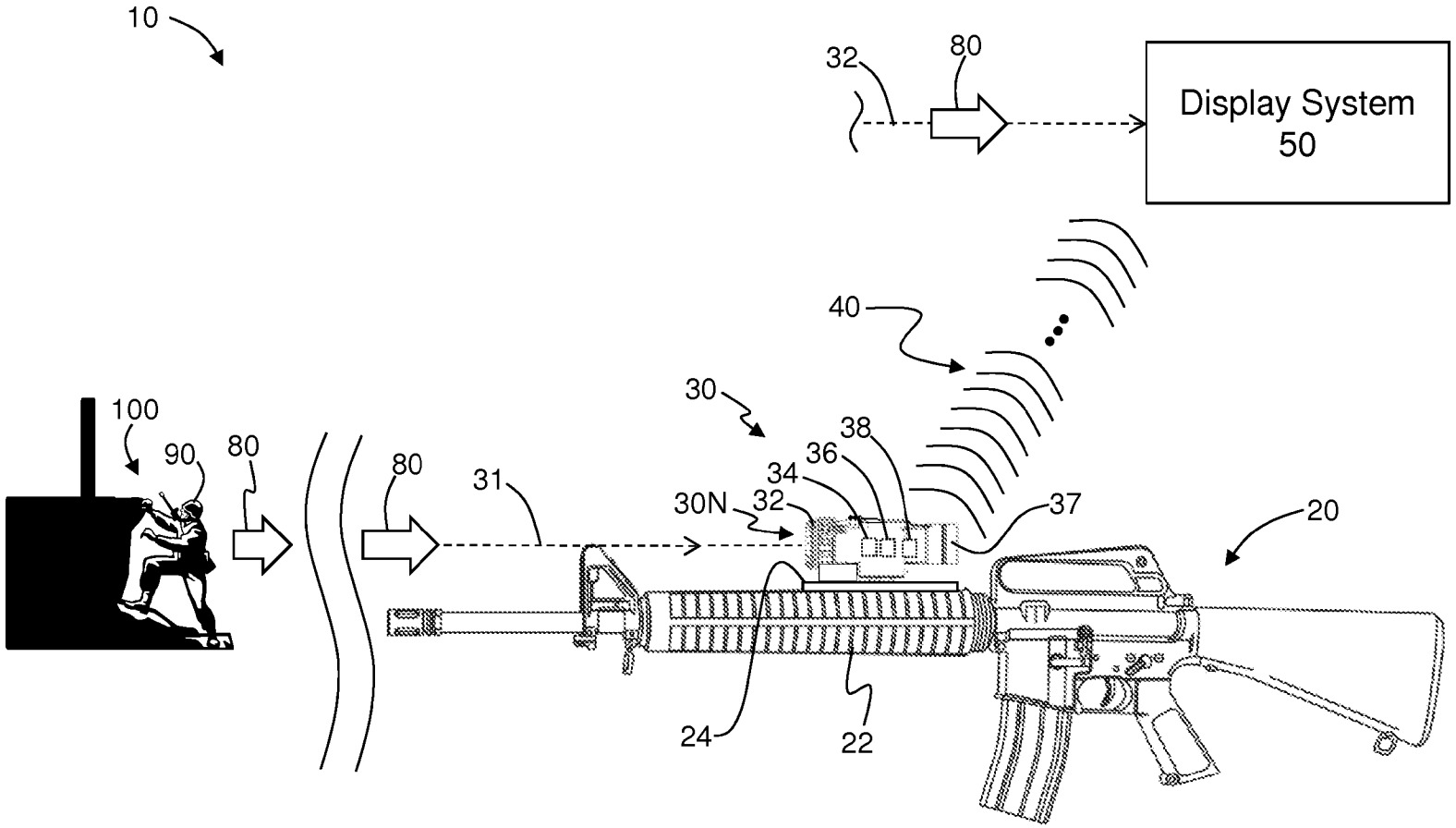
FIG. 1 is a diagram of example weapon-sight system that shows a side view of an example weapon with a night-vision weapon sight configured to wirelessly transmit a weapon-sight image to a display system for performing WTA according to the disclosure.
Figure 2:
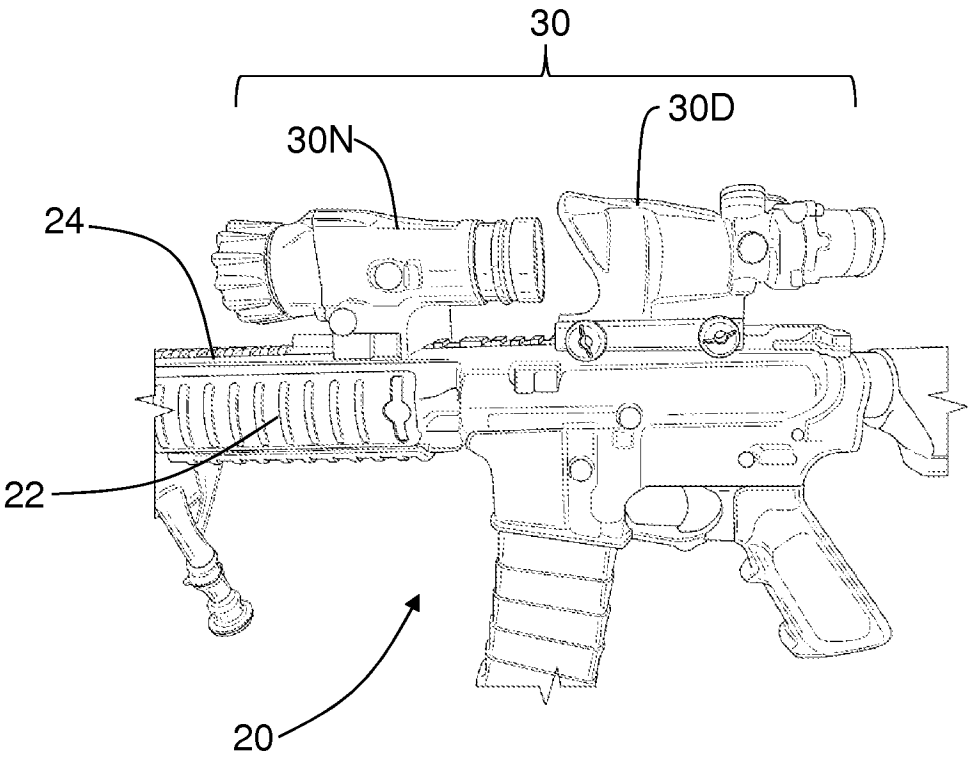
FIG. 2 is a close-up, side elevated view of the central portion of an example weapon that operably supports night-vision optics and day-vision optics mounted to the rail in an in-line configuration.

FIG. 1 is a diagram of example weapon-sight system ("system") 10 for wireless target acquisition (WTA) according to the disclosure. System 10 includes a weapon 20, which by way of example is shown as a rifle, and a weapon sight 30 operably supported thereon. FIG. 2 is a close-up, side elevated view of a central portion of the example weapon-sight system 10 and weapon 20. Weapon 20 has a barrel 22 that supports a rail 24, which in an example is a military-standard rail. Rail 24 operably supports a day sight 30D and/or a clip-on night-vision weapon sight (hereinafter, "night sight") 30N.

FIG. 1 shows an example embodiment wherein weapon sight 30 consists of only night sight 30N. Night sight 30N includes a night-vision optical system 32 (hereinafter, "NV objective"), a thermal sensor 34, a display 36, an eyepiece assembly 37, an inertial measurement unit IMU, and a wireless RF transmitter 38.

System 10 also includes a display system 50. Display system 50 can be a head-borne vision system, such as a night-vision goggle (NVG), enhanced night-vision goggle (ENVG), a heads-up display (including a helmet-mounted heads-up display or a vehicle-mounted heads-up display), or any other type of display. Display system 50 is not physically connected to weapon sight 30 but is within wireless communication range. In an example, display system 50 is configured to perform image intensification ($I^2$).

Figure 3A:
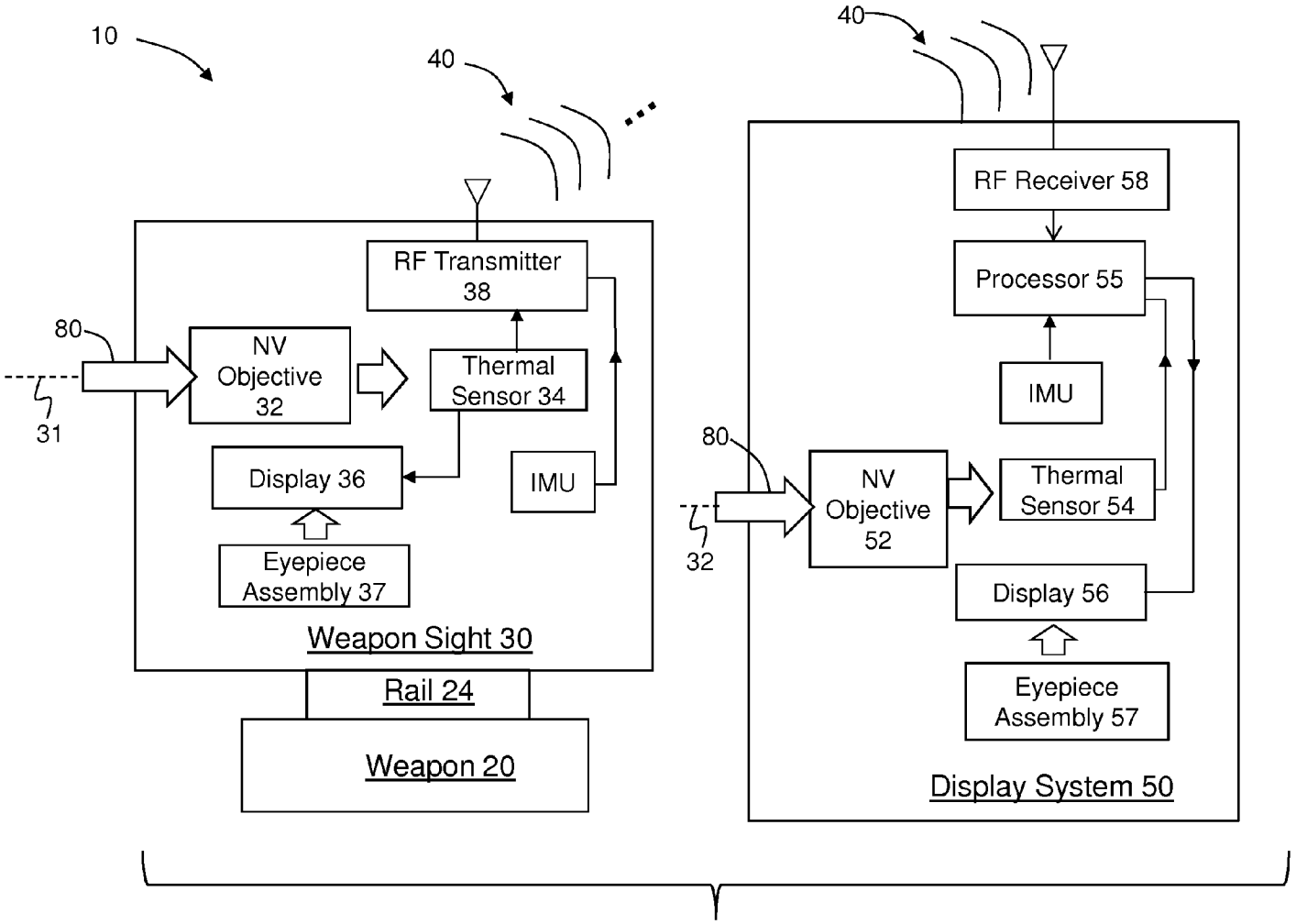
FIGS. 3A and 3B are schematic diagrams of examples of the weapon-sight system for performing WTA according to the disclosure.
Figure 3B:
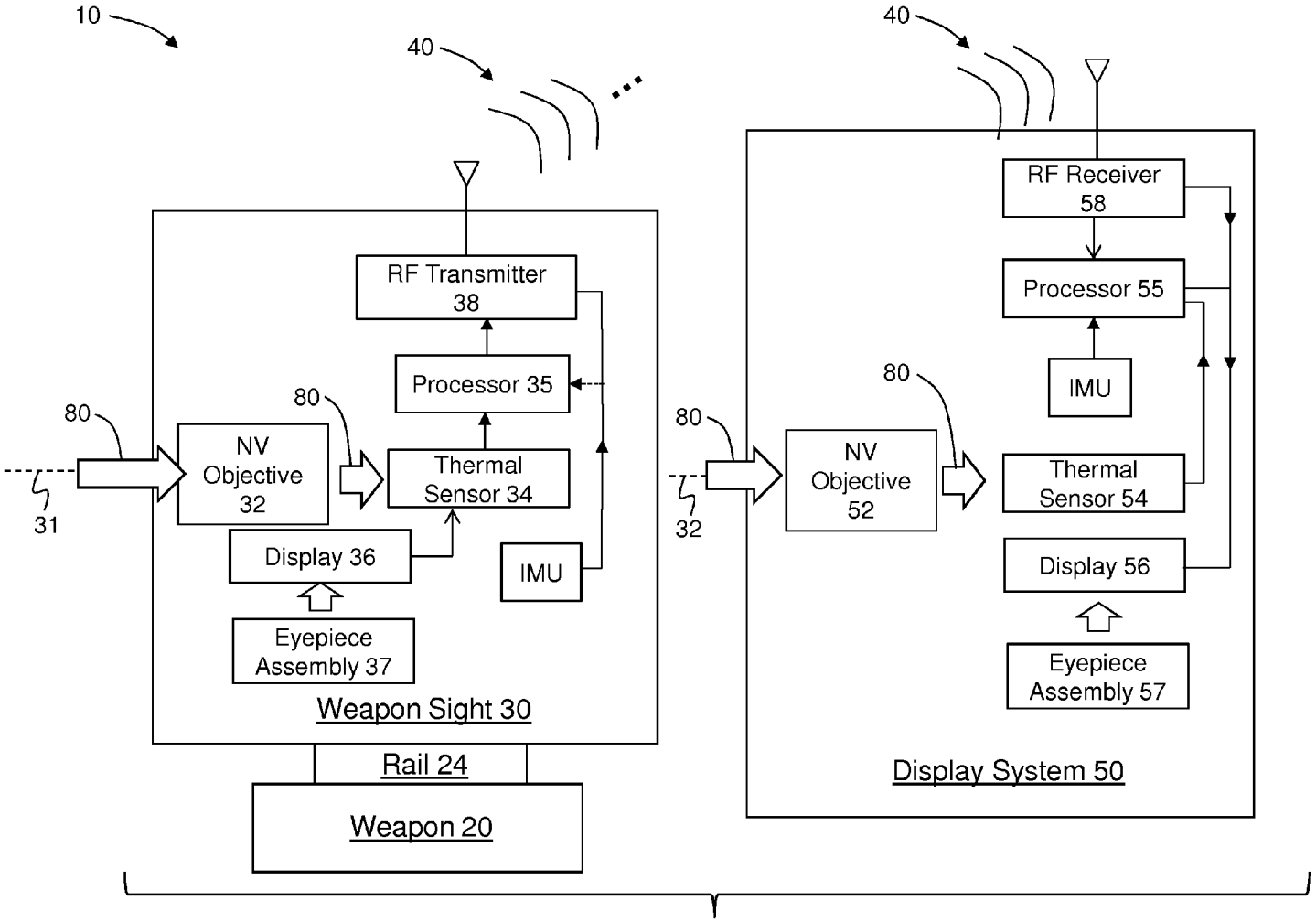

The schematic diagrams of FIGS. 3A and 3B show example embodiments of system 10 wherein display system 50 is adapted for night vision. Display system 50 includes an NV objective 52, a thermal sensor 54 electrically connected to a processor 55, a display 56 electrically connected to the processor, and an eyepiece assembly 57 that allows for the user to view display 56. Display system 50 also includes an inertial measurement unit IMU electrically connected to processor 55. Display system 50 further includes a RF receiver 58.

FIG. 3B illustrates an example embodiment wherein night sight 30N includes a processor 35 configured to perform processing of the thermal image from thermal sensor 34 and other processing required for the operation of night sight 30N, such as pre-processing inertial data from the weapons-sight inertial measurement unit IMU if necessary.

Figure 4A:
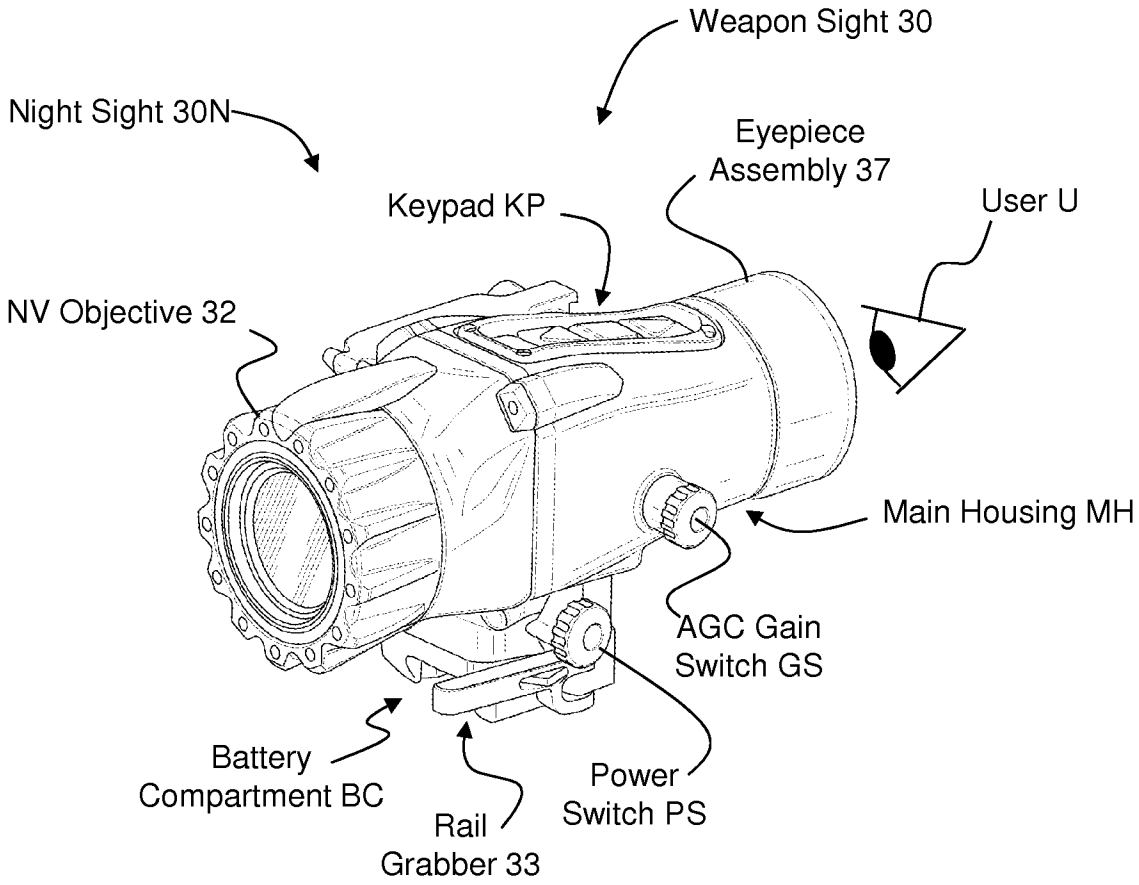
FIG. 4A is an elevated view a of an example night-vision weapon sight according to the disclosure.
Figure 4B:
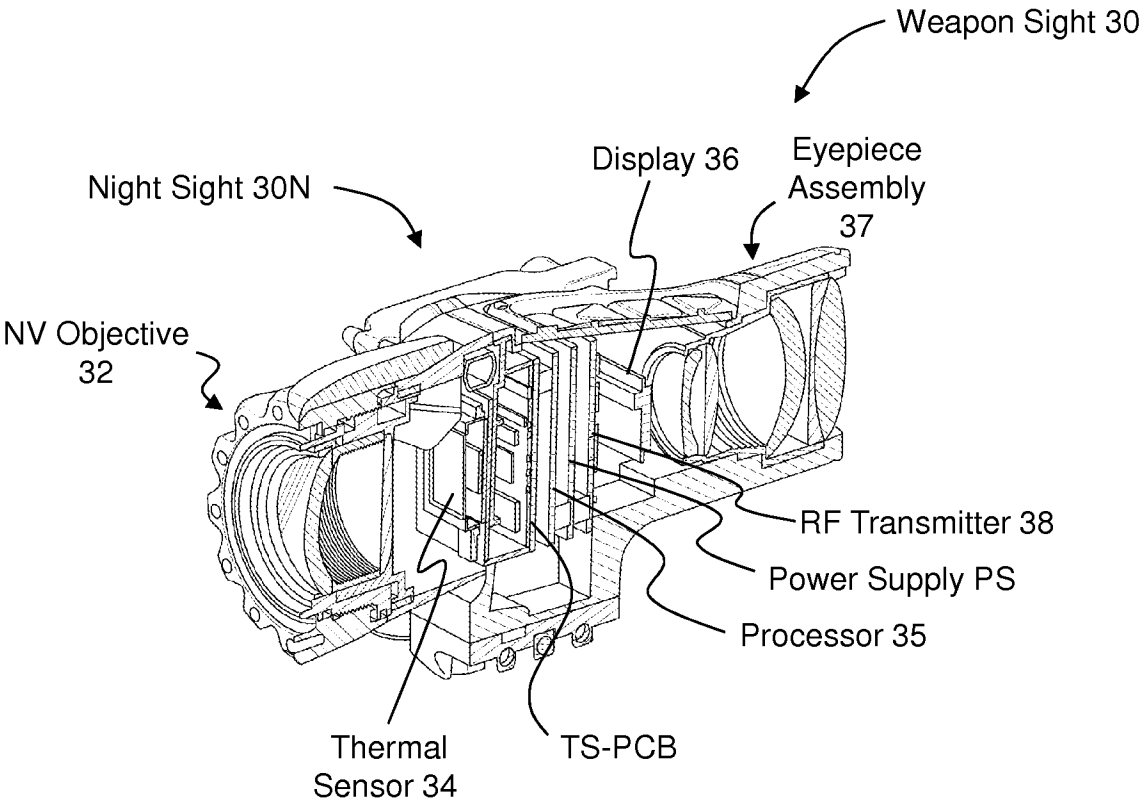
FIG. 4B is a cut-away view of the example night-vision weapon sight of FIG. 4A.

FIG. 4A is an elevated view and FIG. 4B is a cut-away elevated view of an example night sight 30N that includes the aforementioned NV objective 32 that includes passive thermal night-vision optical elements. The night sight 30N also includes rail grabber 33 for mounting to rail 24 (see FIG. 1), a power switch PS, an AGC gain switch GS, eyepiece assembly 37, a keypad assembly ("keypad") KP for entering information, and a main housing MH that houses the various components. Night sight 30 also includes a battery compartment BC for operably storing one or more batteries (not shown) that power the night sight. A user U is shown looking into the eyepiece assembly 37.

An example thermal sensor 34 comprises a focal plane array (FPA), such as a Vanadium Oxide (VOx) 640×480 FPA. In an example, thermal sensor 34 is an uncooled and has VGA resolution or higher.

Also as shown in FIG. 4B, night sight 30N includes a printed circuit board TS-PCB for the thermal sensor 34, a processor 35, a power supply PS, and an RF transmitter 38. In an example, RF transmitter 38 comprises an ultra-wide-band (UWB) wireless PCB that includes or is otherwise combined into a single processor 35. Also in an example, display 36 is an OLED display, e.g., with 1280×1024 resolution. In an example, display 36 can have SXGA resolution or higher.

Figure 4C:
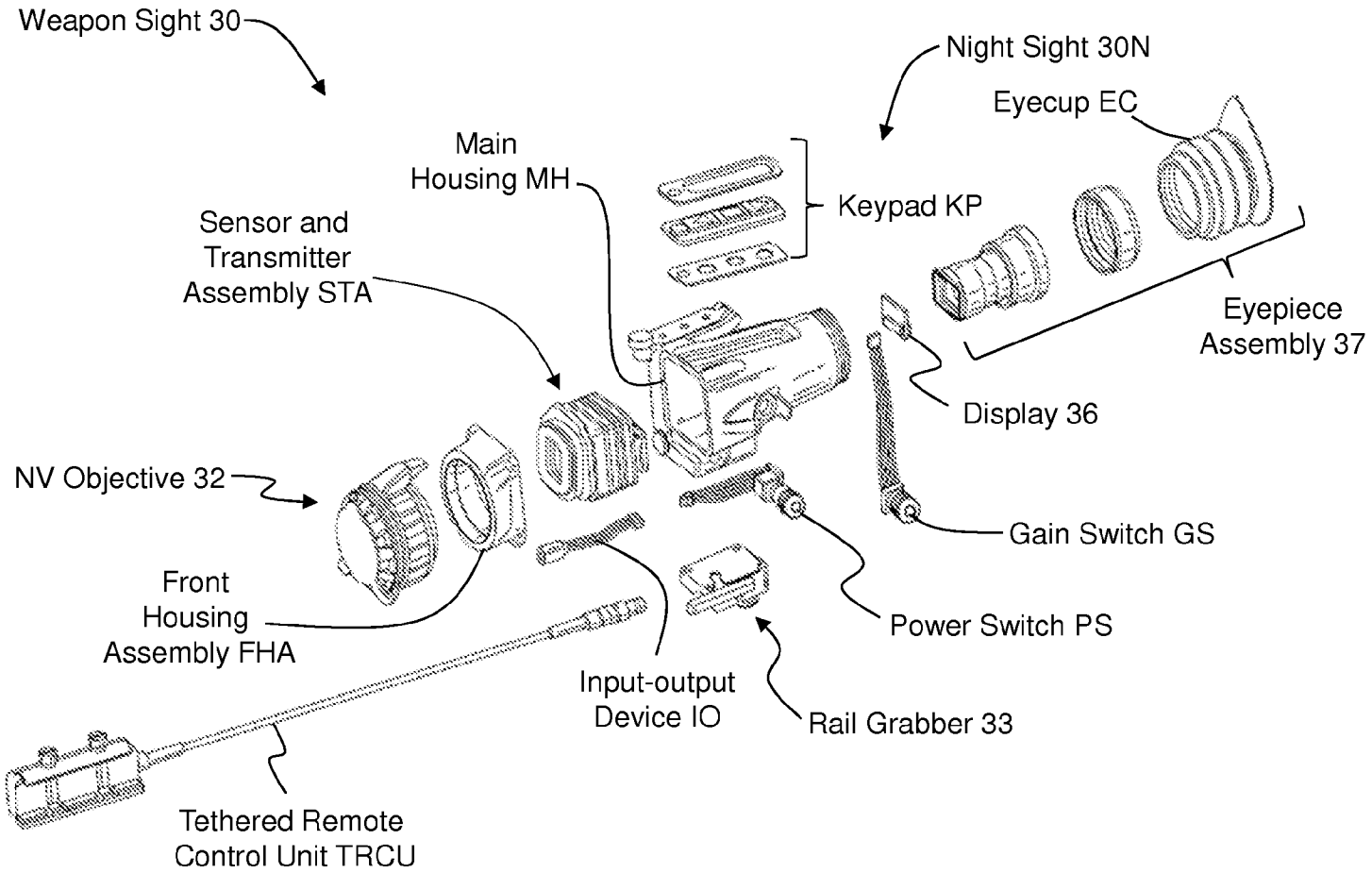
FIG. 4C is a front elevated and exploded view of the example night-vision weapon sight of FIGS. 4A and 4B and showing some additional components.

FIG. 4C is an exploded view of night sight 30N that shows the aforementioned components, as well as a tethered remote control unit RCU that allows the user to conveniently control the operation of night sight 30N while supporting the weapon 20. Also shown is an eyecup EC for eyepiece assembly 37, a front housing assembly FHA that supports NV objective 32, an input-output Device IO, (e.g., a 9 pin cable/bus), and a sensor and transmitter assembly SA that includes thermal sensor 34, thermal-sensor printed circuit board TS-PCB, power supply PS, and RF transmitter 38.

With particular reference to FIG. 1 and to FIGS. 3A and 3B, in the general operation of system 10, infrared (IR) light 80 from a target 90 within a scene 100 travels to night sight 30N along a line of sight 31. The IR light 80 is received by NV objective 32, which forms an image on thermal sensor 34. The thermal sensor 34 generates an electrical sensor signal that is processed by the thermal-sensor PCB (TS-PCB) and the PCB of RF transmitter 38 (collectively, processor 35 in FIG. 3, for example) to generate a signal representative of the weapon-sight image. This weapon-sight-image signal is received by display 36. Display 36 then displays the weapon-sight image embodied in the weapon-sight-image signal. The user U (e.g., a soldier) can view the image displayed on display 36 via eyepiece assembly 37 (see FIG. 4A). The weapon-sight image can include target information, e.g., bullet impact point, aimpoint, etc., as represented by cross-hairs or the like.

The weapon-sight-image signal is used by RF transmitter 38 to transmit a corresponding RF wireless signal 40 to wireless RF receiver 58 of display system 50. RF receiver 58 converts the received RF wireless signal 40 to a corresponding electrical signal, which is transmitted to processor 55. In an example, RF wireless signal 40 is encrypted by processor 35 or by RF transmitter 38 and is then decrypted by RF receiver 58 or by processor 55.

Meanwhile, NV objective 52 of display system 50 also receives infrared (IR) light 80 from target 90 within a scene 100 along a line of sight 32. The NV objective 52 forms a thermal image on thermal sensor 54, which in response generates an electrical sensor signal that is processed by thermal sensor electronics (not shown) and then is sent to processor 55 as a display-system-image signal. In an example, the weapon-sight-image signal and the display-system image signal are each video signals.

In an example, the RF wireless signal 40 covers frequencies from 3 GHz to 11 GHz, and can support up to seventy unique channels, using a low-power design architecture (for long battery life on helmet or weapon mounted systems). In an example, each channel is 528 MHz wide, and is composed of 122 Orthogonal Frequency Division Multiplexing (OFDM) subcarriers. Each carrier contains a different amount of information depending on the data rate being used. A key attribute of UWB comes from the fact that entire subcarriers can be blocked but the overall data will still go through since UWB can have redundancy in both time and frequency. Thus, if a typical 5 MHz interferor knocks out five subcarriers, the upper frequencies of the band will have the same data transmitted and no link data will be lost. The UWB architecture has the capability to scan across all frequencies. If a persistent interferor is detected, the radio link can change frequencies to avoid the interferor while never dropping the link or slowing the transfer of data.

In an example, RF wireless signal 40 is also received and processed by test measurement and diagnostic equipment (TMDE) (not shown) for testing, measurement, diagnosis and/or calibration purposes.

At this point in the process, there are two images in processor 55: the weapon-sight image WS-IM and the display-system image DS-IM. The processor 55 is configured to process these two (video) images so that the target (targeting) information (e.g., cross-hairs, bullet impact point, aimpoint, target zero, etc.) from the night sight 30N is accurately located within or relative to the display-system image DS-IM.

Figure 5:
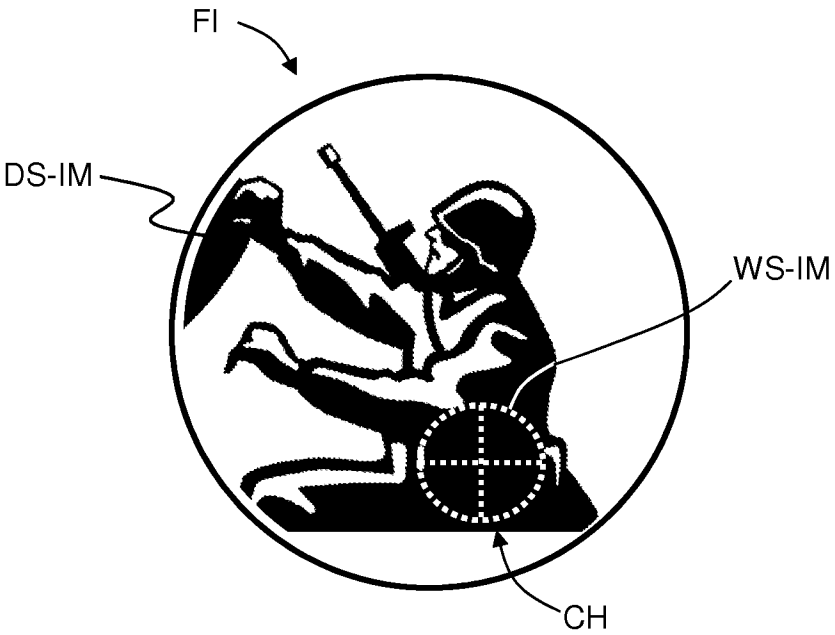
FIG. 5 is an illustration of an example fused imaged that combines the display-system image and the weapon-sight image.

An example of a combined (fused) image FI is shown in FIG. 5, which shows the display-system image DS-IM with the target information (shown by way of example as the white-dotted-line cross-hairs CH) from the weapon-sight image WS-IM. In an example, processor 55 is configured to process the weapon-sight image WS-IM and the display-system image DS-IM so that at least a portion of each image is combined and displayed on or with display 56. This is illustrated in FIG. 5, where the cross-hairs CH portion of the weapon-sight image WS-IM is combined with the display-system image DS-IM. In another example, processor 55 is configured to cause just one or the other image to be displayed on display 56.

Thus, in an example embodiment, system 10 is arranged so that night sight 30N wirelessly exports weapon-sight image WS-IM to display system 50 and display 56 therein. In the example where display system 50 is head-mounted display system such as a NVG or ENVG, the user need not doff the head-mounted display system to look through the night-vision weapon sight 30N to acquire target 90. Rather, the target acquisition information is presented to the user directly via display 56 of display system 50 when the weapon-sight image WS-IM (or portions thereof) is within the display system field of view (FOV) so that target information (e.g., aspects of the weapon-sight image, such as cross-hairs, bullet impact point, aimpoint, target zero, etc.) can be seen in proper orientation by the user. This allows the weapon user to accurately shoot at target 90 without having to physically look through the night sight 30N. Thus, the weapon user can literally shoot from the hip while still having visual target information provided via display 56.

Also in an example embodiment, system 10 utilizes two 9-axis IMUs—one in night sight 30N and one in display system 50—to obtain precise optical alignment between the weapon-sight image WS-IM and display-system image DS-IM when the weapons-sight image is within the display system FOV. The respective IMUs also provide motion-sensing information (linear, rotational and translational) for weapon 20 and display system 50 when the weapon-sight image WS-IM is not within the display system FOV. The IMUs leverage inertial sensing for short-term accuracy and leverage magnetic sensing for long-term accuracy.

In an example embodiment, processor 55 is configured to provide distributed phase locking for low image latency, artifact-free image fusion of the display-system image DS-IM and the weapon sight image WS-IM, and accurate optical position sensing. In an example, the IMUs include circuitry configured to perform signal processing and that inserts matching sets of IMU data into every frame of the video streams on both platforms (i.e., from night sight 30N and display system 50) and transmit them to the processor 55 for processing. The processor 55 is configured to receive and decode weapon-sight video data and display-system video data, as well as the embedded IMU information, perform video buffering to align image data temporally, and then perform image rotation, scaling and warping, based on the IMU data. The processed video is then transmitted to display 56 of the display system 50 for display as fused (video) image FI.

In an example, the UWB RF wireless transmitters and receivers 38 and 58 automatically adjust RF transmit power for the minimum level required to maintain a successful link with the bandwidth required, combined with the distance and orientation of the ENVG and the weapon sight.

Figure 6A:
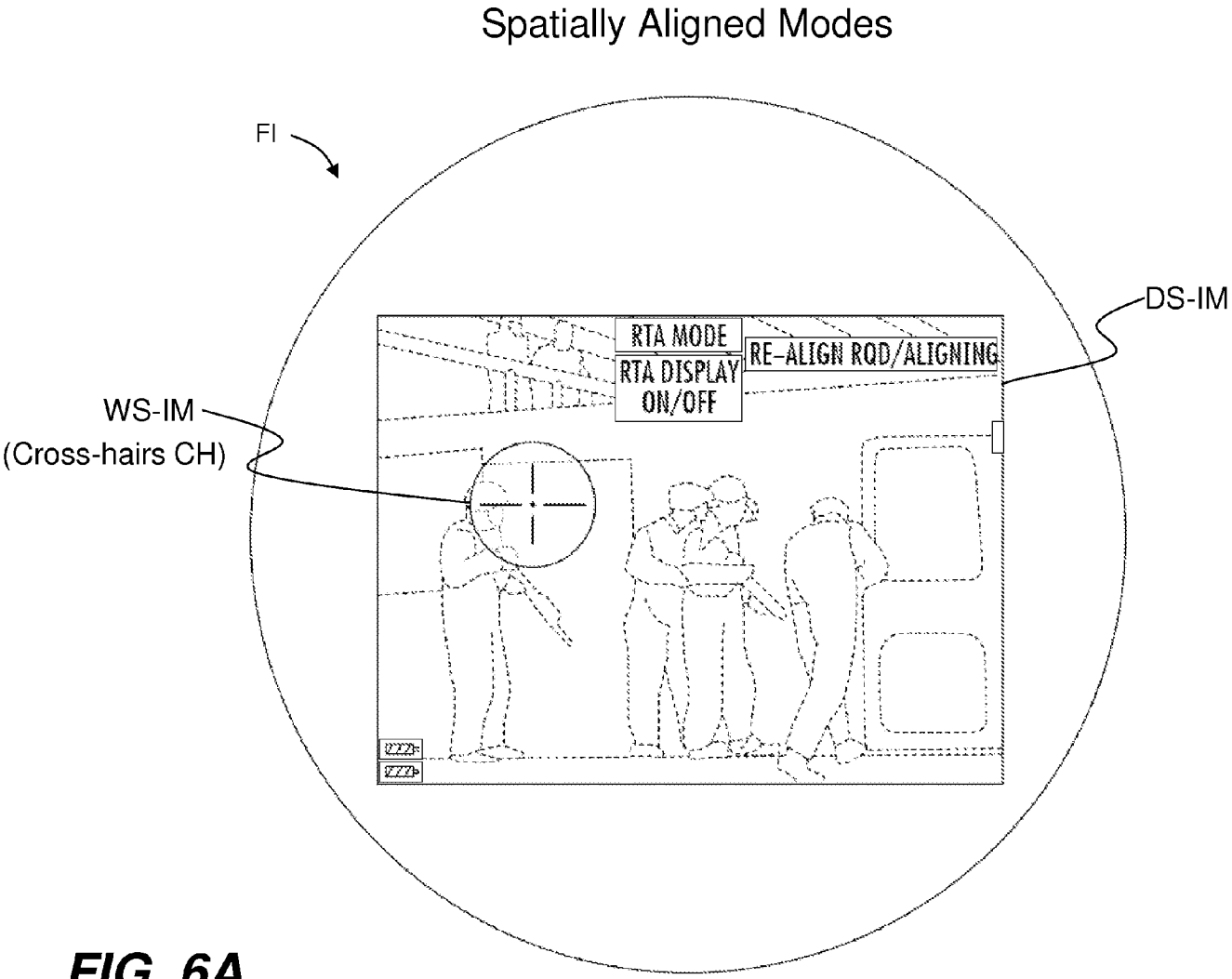
FIG. 6A is similar to FIG. 5 and illustrates an example fused image wherein targeting information in the form of cross-hairs from the weapon-sight image is fused with the display-system image.
Figure 6B:
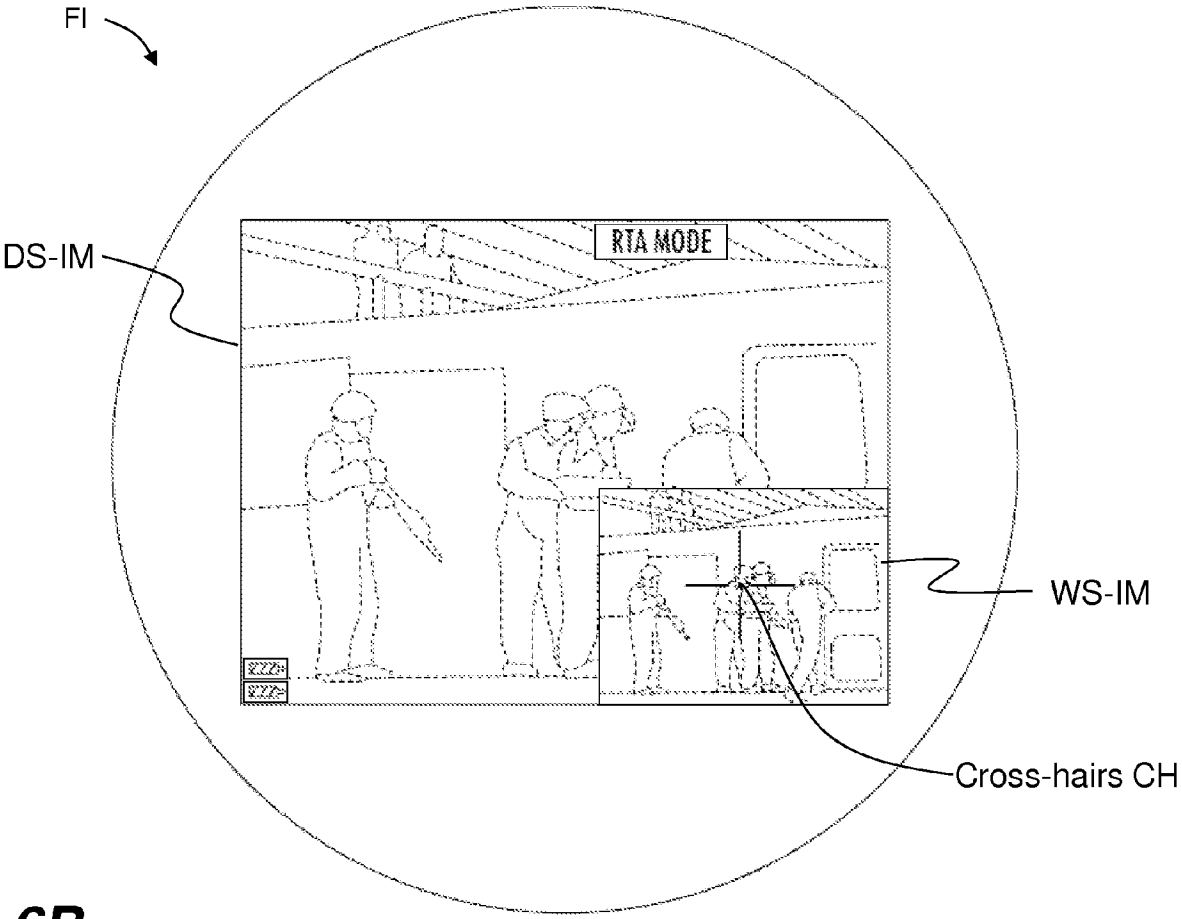
FIG. 6B is an example of a fused image in a picture-in-picture (PiP) format wherein the weapon-sight image is within the display-system image.
Figure 6C:
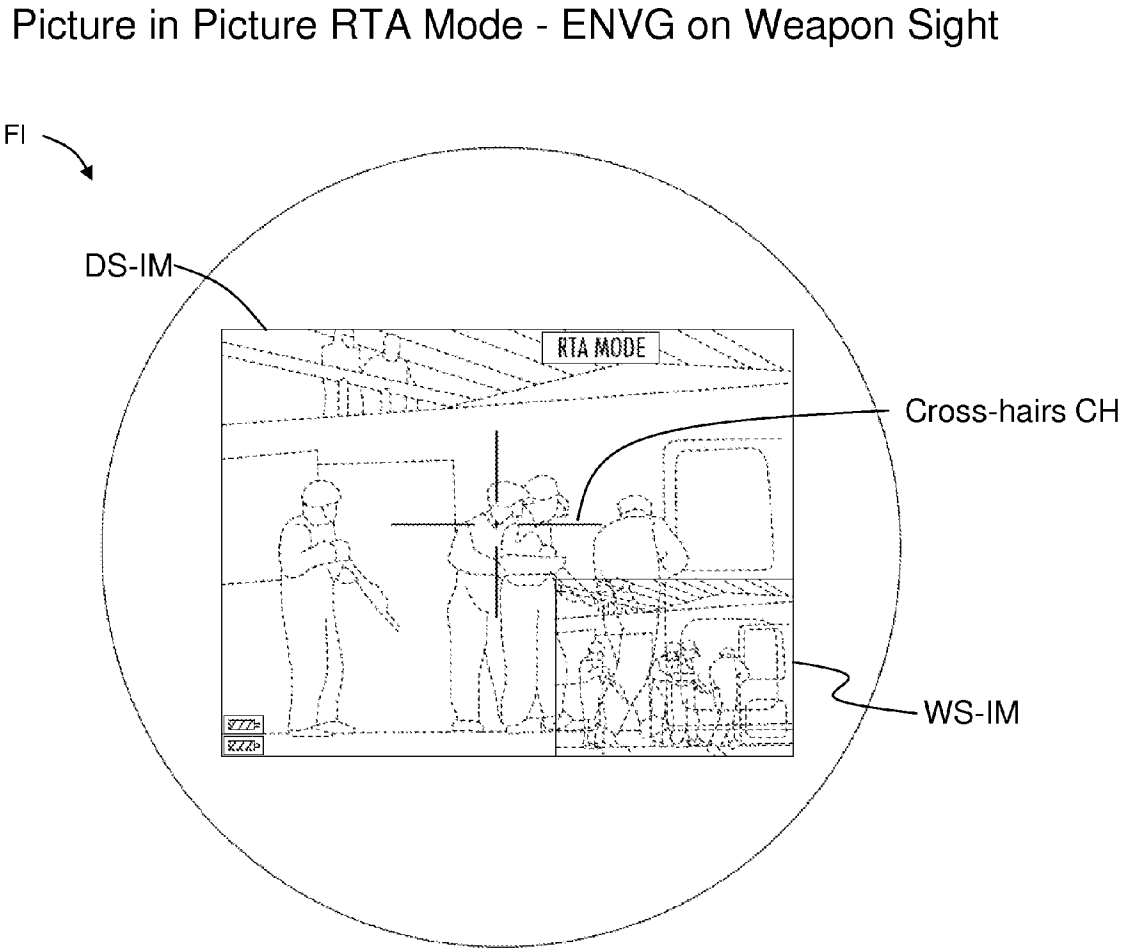
FIG. 6C is similar to FIG. 6B, and shows a PiP format wherein the display-system image is within the weapon-sight image.
Figure 6D:
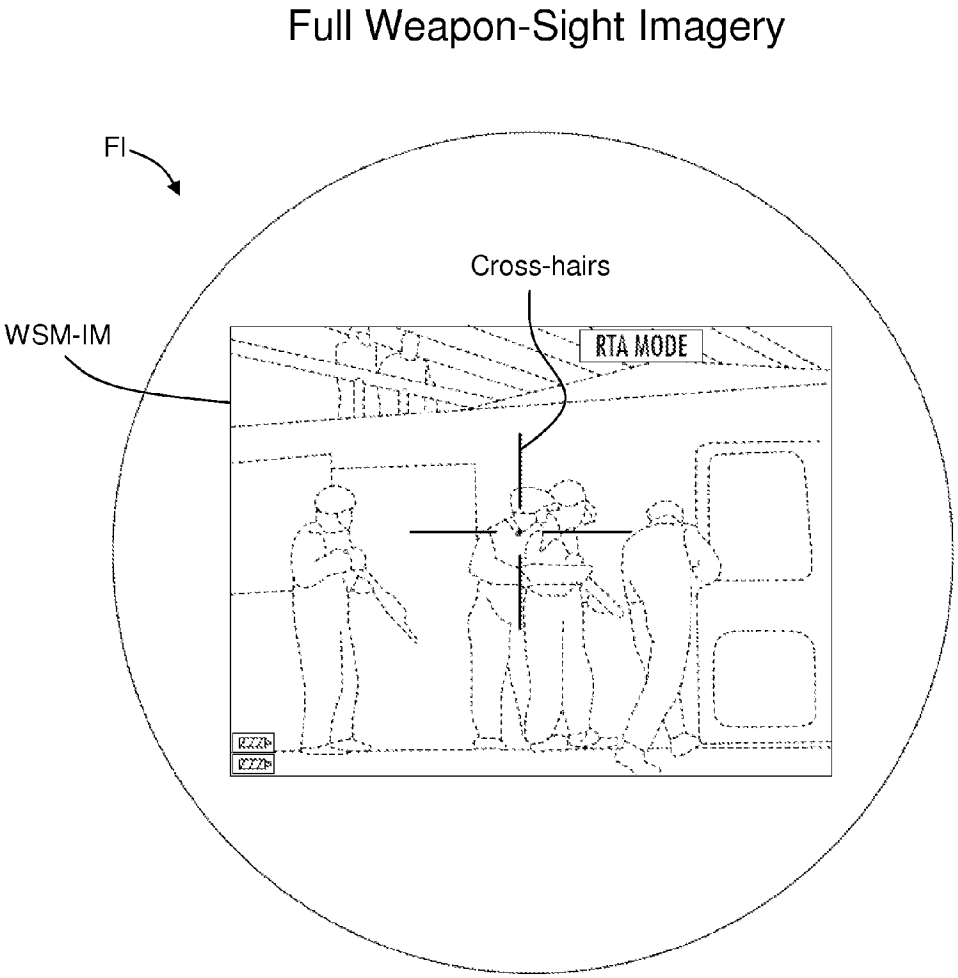
FIG. 6D shows an example wherein the weapon-sight image is provided on the display of the display system.

In an example, system 10 includes the following modes of operation: Spatially aligned with full weapon-sight imagery ($I^2$ & Thermal on), such as illustrated in FIG. 6A; Picture-in-picture (PiP) mode, such as illustrated in FIGS. 6B and 6C, wherein one picture is the display-system image (video) DS-IM and the other picture is the weapon-sight image (video) WS-IM; FIG. 6D shows the full weapon-sight image WS-IM only, with the image intensification ($I^2$) of the display system turned off. This last mode is useful, for example, when the user cannot physically look around a corner but can point the weapon around the corner. In such a case, it can be useful to turn off the display-system image. Other combinations of weapons-sight image WS-IM and display-system image DS-IM can be displayed on display 56.

In an example embodiment of system 10, the IMUs also provide real-time position information over short distances when a GPS signal is not available. The IMUs are configured to directly measure fine linear, translational and rotational motion, so that such motion can be processed (e.g., integrated/summed) to provide position information. For example, IMUs can be used to count steps, sense whether the user is climbing up stairs or going down stairs, remaining stationary, etc. This ability provides continuous fine-grained position of individual users (e.g., squad members), even where GPS is denied, such as when the user (e.g., soldier) is inside buildings/tunnels or in other close-combat urban warfare environments without GPS updates.

Because the IMUs have nine degrees of freedom (Roll Pitch, Yaw, Vertical, Lateral, Translational and Magnetic X, Y & Z to correct for IMU drift), the weapon-sight IMU allows for locating a position of an image in de-rolled, image-stabilized object space with minimal information transfer latency so that the viewer (user U) sees substantially in real-time (i.e., without substantial delays), regardless of the movement of the weapon 20, the user's head, or the user's vehicle (in case of a vehicle-mounted HUD as display system 50).

An aspect of system 10 is that the displayed information on display 56 of display system 50 can be electronically scaled (e.g., via processor 55) so that the "through the scope" magnification remains 1:1 without any changes to boresight alignment of night sight 30N.

It will be apparent to those skilled in the art that various modifications to the preferred embodiments of the disclosure as described herein can be made without departing from the spirit or scope of the disclosure as defined in the appended claims. Thus, the disclosure covers the modifications and variations provided they come within the scope of the appended claims and the equivalents thereto.

What is claimed is:

1. A weapon-sight system for use with a weapon for performing wireless acquisition of a target, comprising:

a weapon sight that is mountable onto the weapon and that is adapted to capture a thermal weapon-sight image of the target, the weapon sight having a wireless transmitter to generate a first wireless signal representative of the weapon-sight image of the target;

a display system that is not physically connected to either the weapon sight or the weapon, wherein the display system includes:

a) a night-vision optical system and thermal sensor adapted to capture a display-sight image of the target and generate a second electrical signal representative of the display-system image of the target;

b) a wireless receiver adapted to receive the first wireless signal and generate a first electrical signal;

c) a display;

d) a processor that receives and processes the first and second electrical signals and causes the display to display either: a) at least a portion of the weapon-sight image, or b) a combination of at least a portion of the weapon-sight image and at least a portion of the display-system image; and e) wherein the weapon sight further includes a first inertial measurement unit that generates weapon-sight inertial data, the display system further includes a second inertial measurement unit that generates display-system inertial data, and wherein the processor is configured to receive and process the weapon-sight inertial data and the display-system inertial data to align the weapon-sight image relative to the display-system image.

2. The weapon-sight system according to claim 1, wherein the display system comprises a night-vision goggle.

3. The weapon-sight system according to claim 1, wherein the display system comprises a heads-up display.

4. The weapon-sight system according to claim 1, wherein the processor is configured to import targeting information from the weapon-sight image into the display-system image.

5. The weapon-sight system according to claim 1, wherein the first wireless signal is encrypted at the weapon and decrypted at the display system.

6. The weapon-sight system according to claim 1, wherein the weapon-sight image includes targeting information.

7. The weapon-sight system according to claim 6, wherein the targeting information includes at least one of: cross-hairs, an aimpoint, target zero, and a bullet impact point.

8. The weapon-sight system according to claim 1, wherein the first wireless signal has an ultra-wide bandwidth.

9. The weapon-sight system according to claim 1, wherein the processor is configured to generate a picture-in-picture configuration of the weapon-sight image and the display-system image.

10. A method of performing wireless acquisition of a target for use by a user, comprising:

capturing a thermal weapon-sight image of the target using a weapon sight on a weapon without the user looking through the weapon sight;

capturing a display-system image of the target using a display system that is not physically connected to either the weapon sight or the weapon;

wirelessly transmitting the weapon-sight image to the display system;

performing first inertial measurements at the weapon sight and second inertial measurements at the display system;

aligning the weapon-sight image with the display-system image based on the first and second inertial measurements; and displaying at least a portion of the weapon-sight image on a display of the display system so that the user can view the weapon-sight image using the display system.

11. The method according to claim 10, wherein the weapon comprises a long-range weapon.

12. The method according to claim 10, wherein the display system comprises a night-vision goggle.

13. The method according to claim 10, wherein the display system comprises a heads-up display.

14. The method according to claim 10, further comprising combining the at least portion of the weapon-sight image with at least a portion of display-system image.

15. The method according to claim 10, wherein the weapon-sight image includes targeting information.

16. The method according to claim 15, wherein the targeting information includes at least one of: cross-hairs, an aimpoint, target zero, and a bullet impact point.

17. A weapon-sight system for performing wireless acquisition of a target for use by a user having a weapon, comprising:

a weapon sight adapted to capture a weapon-sight image of the target using a weapon-sight on the weapon without looking through the weapon sight, wherein the weapon sight includes a first inertial measurement unit that generates first inertial data;

a display system that is not physically connected to either the weapon sight or the weapon, the display system including a processor and a display and being configured to capture a display-system image, wherein the display system includes a second inertial measurement unit that generates second inertial data;

a wireless transmitter at the weapon sight that is adapted to wirelessly transmit the weapon-sight image and the first inertial data to the display system; and wherein the processor is: a) configured to cause the weapon-sight image to be displayed on the display so that the user of the display system can view the weapon-sight image; and b) wherein the processor is configured to receive and process the first and second inertial data to align the weapon-sight image relative to the display-system image.

18. The weapon-sight system according to claim 17, wherein the weapon sight consists of a night-vision weapon sight.

19. The weapon-sight system according to claim 17, further comprising the weapon.

20. A weapon-sight system for performing wireless acquisition of a target, comprising:

a weapon;

a weapon sight removably attached to the weapon and having a first inertial measurement unit adapted to capture first inertial data, the weapon sight being configured to capture a weapon-sight image of the target without a user looking through the weapon sight;

a display system that is not physically connected to either the weapon sight or the weapon, the display system including a processor and a display and configured to capture a display-system image and including a second inertial measurement unit adapted to capture second inertial data;

a wireless transmitter at the weapon sight that is adapted to wirelessly transmit the weapon-sight image and the first inertial data to the display system; and wherein the processor is adapted to: a) combine at least a portion of the weapon-sight image with at least a portion of the display-system image to form a combined image, and to cause the combined image to be displayed on the display so that a user of the display system can view the combined image; and b) process the first and second inertial data to align the weapon-sight image relative to the display-system image.

21. The weapon-sight system according to claim 20, wherein the weapon-sight image includes targeting information.

22. The weapon-sight system according to claim 21, wherein the targeting information includes at least one of: cross-hairs, an aimpoint, target zero, and a bullet impact point.

23. The weapon-sight system according to claim 20, wherein the weapon sight consists of a night-vision weapon sight.

24. A method of performing wireless acquisition of a target for use by a user, comprising:

capturing a thermal weapon-sight image of the target using a weapon sight on a weapon without looking through the weapon sight, wherein the weapon sight has a position;

capturing a display-system image of the target using a display system that is not physically connected to either the weapon sight or the weapon;

collecting inertial measurement data at the weapon sight and the display system and processing the inertial measurement data to track the position of the weapon sight;

wirelessly transmitting the weapon-sight image to the display system; and displaying at least a portion of the weapon-sight image on a display of the display system so that the user can view the weapon-sight image and the tracked weapon sight position using the display system.

25. The method according to claim 24, wherein the weapon-sight image includes targeting information.

* * * * *